US008243094B2

(12) United States Patent
Lin et al.

(10) Patent No.: US 8,243,094 B2
(45) Date of Patent: Aug. 14, 2012

(54) GRAY SCALE DATA BIT ALLOCATION PROCESSING METHOD WITHIN A LIGHT-EMITTING DIODE DRIVING INTEGRATED CIRCUIT DEVICE

(75) Inventors: Shar-Ming Lin, Taipei (TW); Ching-Pao Chou, Taipei (TW)

(73) Assignee: Formolight Technologies Inc., Taipei (TW)

( * ) Notice: Subject to any disclaimer, the term of this patent is extended or adjusted under 35 U.S.C. 154(b) by 0 days.

(21) Appl. No.: 12/189,173

(22) Filed: Aug. 10, 2008

(65) Prior Publication Data

US 2011/0227953 A1 Sep. 22, 2011

(30) Foreign Application Priority Data

Jan. 30, 2008 (TW) ..... 97103588 A

(51) Int. Cl.
*G09G 5/02* (2006.01)

(52) U.S. Cl. ..... 345/600; 345/605; 345/690

(58) Field of Classification Search ..... 345/600, 345/589, 690, 605
See application file for complete search history.

(56) References Cited

U.S. PATENT DOCUMENTS 5,920,305 A * 7/1999 Yoon ..... 345/600

* cited by examiner

*Primary Examiner* — William Boddie
*Assistant Examiner* — Sahlu Okebato
(74) *Attorney, Agent, or Firm* — Rabin & Berdo, P.C.

(57) ABSTRACT

The present invention is related to a gray-scale data bit processing method applied in a driving integrated circuit device of light-emitting diode (LED), and more particularly to a separating and recombining method applied to reduce the bit numbers of data to be processed to indicate the brightness of light-emitting diode, and thus a set of weight values and more updating rates are generated to obtain an identical sum of gray-scale weight values compared to the original one processed at a higher bit numbers of data operation.

7 Claims, 3 Drawing Sheets

GRAY SCALE DATA BIT ALLOCATION PROCESSING METHOD WITHIN A LIGHT-EMITTING DIODE DRIVING INTEGRATED CIRCUIT DEVICE

BACKGROUND OF THE INVENTION (a) Field of the Invention

The present invention relates to a gray-scale data bit processing method applied in a driving integrated circuit device of light-emitting diode (LED), and more particularly to a separating and recombining method applied to reduce the bit numbers of data to be processed to indicate the brightness of LED, and thus a set of weight values and more updating rates are generated to obtain an identical sum of gray-scale weight values corresponding to the original one processed at a higher bit numbers of data operation. With such a method, the present invention provides the separated high-bit data with a higher updating rate and the total sum of weight value of the original gray-scale data can be processed and calculated within the same time period without any data error. Consequently, the present invention provides a solution with less working load of the separated gray-scale data bits, but also accomplishes a better updating rate of bit value operation which contributes the same and accurate gray-scale brightness shown by the LED. Thus, the present invention is applicable for a driving integrated circuit device by which a set of higher gray-scale data bits are processed to indicate the brightness of light-emitting diode.

(b) Description of the Prior Art

The light-emitting diode (LED) had been a very popular electronic component applied in the lighting industry. And, digital solution provides an efficient and quick way to control the brightness of LED which is fed with the information containing a series of bit values. The more bit values of control information, the quicker LED performance illustrates the brightness.

However, the processing of more bit values means a higher hardware required to indicate the identical brightness generated from the LED within a very short period. The prior art meets the drawback that the bit-error of a series of bit values happens during the transmission process to the LED Thus, how to accurately process the gray-scale data bit in a driving integrated circuit device of LED has been a critical issue and technology in this field.

The prior art is related to the gray-scale data bit processing method applied in a driving integrated circuit device of LED generally consists of the processing of bit array, bit values and the defined weight values of the original gray-scale data within a LED driving integrated circuit device. Generally speaking, the grey-scale is both a measuring content and control information of the brightness generated from the LED.

Please refer to FIG. 1 of the present invention, which takes a 12-bit original gray-scale data as an example. The 12-bit original gray-scale data (as shown in FIG. 1) comprises a bit array A1: 0-11 (Total 12 bits from 0 to 11); bit values (from the lower bit) A2: 1, 1, 0, 0, 1, 1, 0, 0, 1, 1, 0, 1; defined weight values (from the lower bit) A3: 1, 2, 4, 8, 16, 32, 64, 128, 256, 512, 1024, 2048. Accordingly, the sum of weight values A4 of the 12-bit original-gray scale data is 2867. The sum of weight values A4 "2867" is calculated by a serial addition of each defined weight values A3 multiplied by its corresponding bit values A2. The number "2867" is also a measuring level and information to control the brightness illuminated by the LED. The so-called "gray-scale" is used to describe the level from dark to complete brightness.

If a gray-scale data bit processing method is adopted by which one original gray-scale data is processed at a time period, once an error of transmission occurs in the bit values A2, then the sum of weight values A4 of the 12-bit original gray-scale data will be affected and leads to a different number which makes the LED components illustrate a different and error brightness during the complete time period. The more gray-scale data bit, the more probability the said drawback and risk exist. Moreover, the prior method is working on a longer series of data bits and is not available to process with a less working load among the hardware of a driving integrated circuit device of LED, and is unable to achieve the effectiveness to enhance the gray-scale bit data updating rate.

Hence, the performance of LED brightness (as a component of illumination) adopts the prior art still needs to be improved.

SUMMARY OF THE INVENTION

Therefore, a primary objective of the present invention is to provide a gray-scale data bit processing method applied in a driving integrated circuit device of light-emitting diode (LED) which uses less operation of bit data to achieve more gray-scale bits, and enables improving the effectiveness to increase the illumination updating rate of high-bit portions and increase practicability.

Please refer to FIGS. 2 and 3. In order to achieve the aforementioned objectives, the present invention takes an example of a 12-bit original gray-scale data and comprises the following steps:

1. Dividing the original gray-scale data into high-bit data and low-bit data within a driving integrated circuit device of LED;
2. Converting the low-bit data into eight (8) extra 1-bits added to the high-bit data respectively to form a multi-stack display data which has fewer bits;
3. Adding each high-bit data with corresponding extra 1-bit forms a set of 10-bit multi-stack display data;
4. Converting each defined weight values according to the corresponding bit values located in the multiple display data and accumulating each defined weight value to form a sum of weight values;
5. Displaying an identical sum of weight values and illumination of original gray-scale data by adopting the display data with a higher updating rate.

It means the illumination will repeat eight (8) times of updating rate within the same time period with less gray-scale data bits hardware requirement. Accordingly, the present invention is provided with the effectiveness to operate more gray-scale data bits and reduce probability for errors in bit transmission, as well as improving the illumination refreshing rate of the high-bit portions and increasing functionality.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
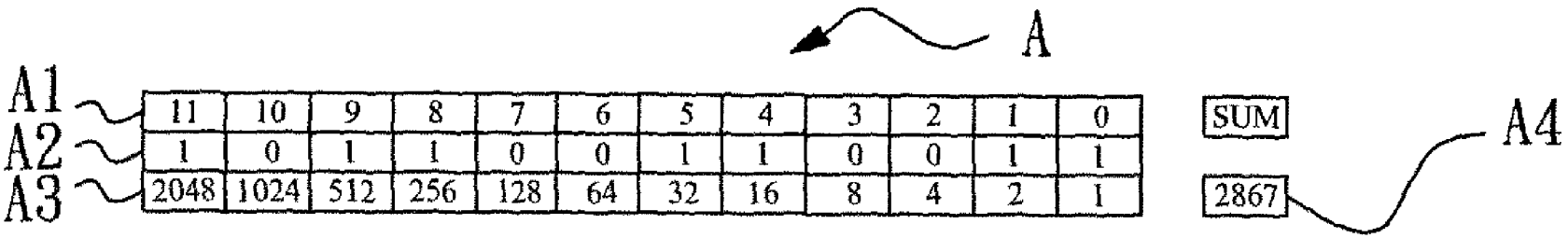
Fig. 1 Prior Art
FIG. 1 is a schematic view of the prior art.
Figure 2:
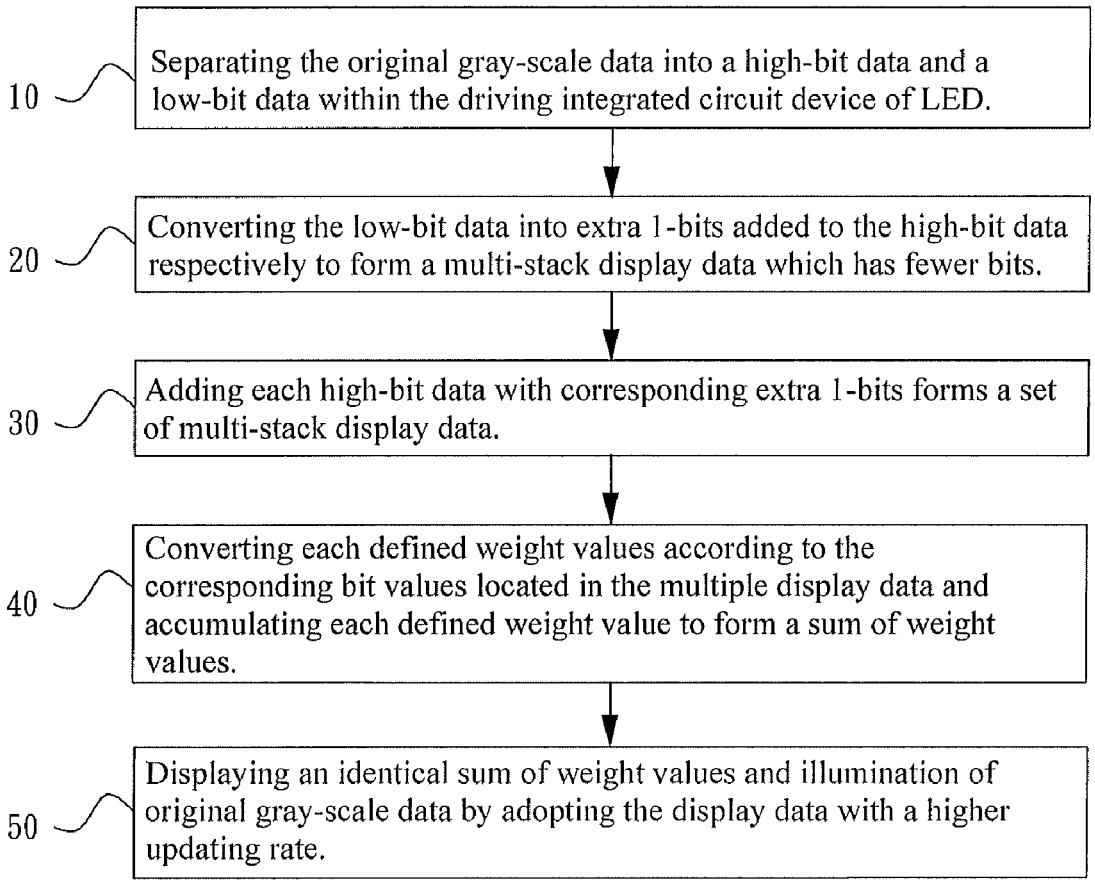
FIG. 2 is a schematic view depicting steps in the present invention.
Figure 3:
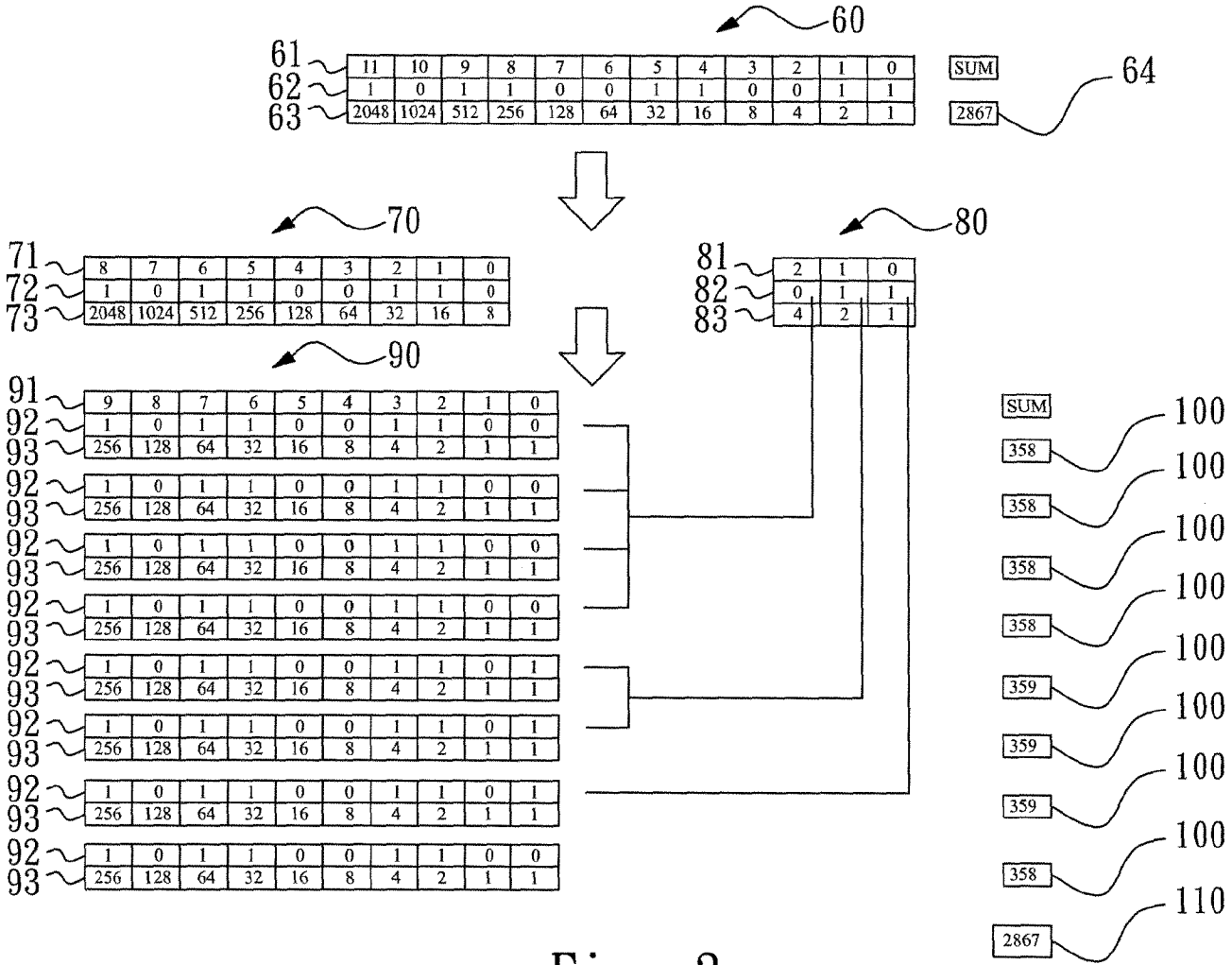
FIG. 3 is a schematic view depicting use of the present invention.

Please refer to FIGS. 2 and 3. To provide a better explanation, the present invention takes an example of a 12-bit original gray-scale data 60 and comprises the following steps:

1. Dividing the original gray-scale data into a high-bit data 70 (9 bits from 0 to 8) and a low-bit data 80 (3 bits from 0 to 2) within the driving integrated circuit device of LED (step 10);
2. Converting the low-bit data 80 (3 bits) into eight (8) extra 1-bits added to the high-bit data 70 (9 bits from 0 to 8) respectively to form a multi-stack display data 90 which has fewer bits (10 bits from 0 to 9) (step 20);

The number of extra 1-bit depends on the bits of the divided low-bit data. That is, the number of extra 1-bit is processed based on 2's power by the bits of the low-bit data. There are 3 bits in the low-bit data and eight extra 1-bits is converted and added to the high-bit data respectively (as shown in FIG. 3). The last extra bit at the bottom of the eight multi-stack display data 90 with bit value 0 and defined weight value 1 is always fixed.

3. Adding each high-bit data 70 with corresponding extra 1-bit to form a set of 10-bit multi-stack display data 90 (10 bits from 0 to 9) (step 30);
4. Converting each defined weight values 93 according to the corresponding bit values 92 located in the 10-bit multi-stack display data 90 and accumulating each defined weight value 100 to obtain a sum of weight values 110; (step 40);
5. Displaying an identical sum of weight values 110 and illumination of original gray-scale data by adopting the display data 90 with a higher updating rate (step 50).

It means the illumination will repeat 8 times of updating rate within the same period with less gray-scale data bits hardware required. Accordingly, the aforementioned steps constitute the gray-scale data bit processing method applied in a driving integrated circuit device of LED. Referring to FIGS. 2 and 3, the present invention is characterized in that it divides the original gray-scale data 60 into two portions including the high-bit data 70 and the low-bit data 80 by means of the light-emitting diode driving integrated circuit device, and the low-bit data 80 is converted into eight (8) extra 1-bits respectively added to the high-bit data 70. Moreover, a increased updating rate which means the frequency of repeating high-bit display data 90 within one complete cycle, and the so-called one complete cycle refers to the time period required to completely display the original gray scale data 60, that is, the time spent by the LED driving integrated circuit device to actuate and completely light up and shut off the LEDs. The scale of brightness of the LEDs is varied and controlled by the data bit, which is called the gray-scale number. The gray-scale data is composed of a plurality of bits, the higher the gray-scale number, the greater the number of bits required to compose the gray scale data. The ascribed weight value of each bit of the gray-scale data entering the driving integrated circuit device of LED is different, and bit values 62, 72, 82, 92 are used to convert the defined weight values 63, 73, 83, 93 to obtain the final displayable gray-scale generated from the LED.

Referring to FIG. 3 (taking the 12-bit original gray-scale data 60 as an example), when in use, the 12-bit original gray-scale data 60 (bit array 61: from 0 to 11; bit values 62 from the lower bit: 1, 1, 0, 0, 1, 1, 0, 0, 1, 1, 0, 1; the defined weight values 63 from the lower bit: 1, 2, 4, 8, 16, 32, 64, 128, 256, 512, 1024, 2048) in the light-emitting diode driving integrated circuit device is first divided into two portions, including the 9-bit high-bit data 70 (bit array 71: from 0 to 8; bit values 72 from the lower bit: 0, 1, 1, 0, 0, 1, 1, 0, 1; defined weight values 73 from the lower bit: 8, 16, 32, 64, 128, 256, 512, 1024, 2048) and the 3-bit low-bit data 80 (bit array 81: from 0 to 2; bit values 82: 1, 1, 0; defined weight values 83: 1, 2, 4), then the 3-bit low-bit data 80 is converted into eight (8) extra 1-bits and added to the high-bit data 70 respectively to form a set of 10-bit display data 90. In other words, the 9-bit high-bit data 70 is added with the extra 1-bit to form the 10-bit display data 90. Meanwhile, the last one of the eight extra 1-bits with bit value 0 and defined weight value 1 is always fixed. the bit values 92 of the eight groups contain those eight extra bit 0s respectively changed from the said 3-bit lower-bit data (from the lower bit): 1,1,0 into four times 0, two times 1, once 1 and the last extra bit assigned bit value 0 and defined weight value 1 is always fixed. Finally, each of the 12-bit original gray-scale data 60 is converted into the 10-bit display data 90 with fewer bits (bit array 91: from 0 to 9; corresponding bit values 92 of the eight groups of bits from 1 to 9 are identical: 0, 1, 1, 0, 0, 1, 1, 0, 1, and the bit values 92 of the eight groups contain those eight extra 1-bits respectively converted from the said 3-bit lower-bit data: 0,1,1 into 4 times 0, two times 1, once 1 and the last extra bit assigned bit value 0 and defined weight value 1 is always fixed. The defined weight values 93 of the eight groups of bits from 1 to 9 of the bit array 91 are identical: 1, 2, 4, 8, 16, 32, 64, 128, 256, and the defined weight values 93 of the eight extra bits 0 of the bits 91 respectively shows: 1, 1, 1, 1, 1, 1, 1, 1), by which the individual weight values 100 of the eight 10-bit display data having less digits of data bit converted from the 12-bit original gray-scale data 60 respectively are 358, 358, 358, 358, 359, 359, 359, 358, which have a sum of weight value 110 of 2867, Hence, the sum of weight value 110 of the eight 10-bit display data having less bits of data bit is identical to the 12-bit original sum of weight value 64 (both being 2867).

Consequently, The present invention provides a solution to reduce the hardware requirement with a narrower band width and a more convenient and safe circuit design to process more gray-scale numbers with enhanced efficiency and accuracy free from bit-error-rate, as well as increase the updating rate of the high-bit portions separated from the original gray-scale data.

To put it short, the present invention is provided with the effectiveness to operate more gray-scale data bits and reduce probability for errors in bit transmission, as well as improving the illumination refreshing rate of the high-bit portions and increasing functionality.

It is, of course, to be understood that the embodiments described herein are merely an illustration of the present invention and that a wide variety of modifications thereto may be effected by persons skilled in the art without departing from the spirit and scope of the present invention as set forth in the following claims.

What is claimed is:

1. A gray-scale data bit processing method applied in a light-emitting diode driving integrated circuit device, comprising the following steps:

(a) dividing original gray-scale data into high-bit data and low-bit data within the light-emitting diode driving integrated circuit device;

(b) converting the low-bit data into extra single bits, each extra single bit being added to the high-bit data to form a multi-stack display data which has fewer bits than the original gray scale data;

(c) adding each high-bit data with corresponding extra single bit to form a set of multi-stack display data;

(d) converting predetermined weight values according to corresponding bit values in the multi-stack display data and accumulating the converted weight values to form a sum of weight values;

(e) displaying an identical sum of weight values and illumination of the original gray-scale data by adopting the display data with a higher updating rate.

2. The gray-scale data bit processing method according to claim 1, wherein the respective predetermined weight values of each display data are assigned, and are recovered to a sum of weight values identical to the original gray-scale data by a repeated updating rate.

3. A method for driving at least one light emitting element in accordance with original gray-scale data having N a plurality of weight value bits, a brightness value being associated with each weight value bit, said method comprising:

(a) dividing the original gray-scale data at a predetermined point into high bit data and low bit data, the high bit data having weight value bits of the original gray-scale data higher than the predetermined point and the low bit data having weight value bits of the original gray-scale data lower than the predetermined point;

(b) forming a set of extra bits from the low bit data;

(c) repeating the high bit data a plurality of times to provide a plurality of repetitions, with the weight values associated with the high bit data being divided by a power of two in the repetitions;

(d) forming a set of display data by adding bits from the set of extra bits to the repetitions;

(e) determining a weight value sum from the set of display data; and (f) driving the at least one light emitting element at an enhanced updating rate in accordance with input data and the weight value sum.

4. The method of claim 3, wherein step (d) comprises adding a 0 bit to one of the repetitions if the least significant bit of the low bit data is 0 and by adding a 1 bit to one of the repetitions if the least significant bit of the low bit data is 1.

5. The method of claim 4, wherein step (d) further comprises adding a 0 bit to two of the repetitions if the next-to-least significant bit of the low bit data is 0 and by adding a 1 bit to two of the repetitions if the next-to-least significant bit of the low bit data is 1.

6. The method of claim 5, wherein step (d) further comprises adding a 0 bit to four of the repetitions if the second-from-least significant bit of the low bit data is 0 and by adding a 1 bit to four of the repetitions if the second-from-least significant bit of the low bit data is 1.

7. The method of claim 3, wherein steps (a) through (e) are executed in at least one integrated circuit.

* * * * *